US009316070B1

(12) United States Patent
Anderson et al.

(10) Patent No.: US 9,316,070 B1
(45) Date of Patent: Apr. 19, 2016

(54) PUMP FOR USE WITH MINE DRILL AND RELATED METHODS

(71) Applicants: Robert Sherwood Anderson, Culloden, WV (US); Sean Joseph McQuerrey, South Charleston, WV (US); Henry E. Wilson, Ironton, OH (US)

(72) Inventors: Robert Sherwood Anderson, Culloden, WV (US); Sean Joseph McQuerrey, South Charleston, WV (US); Henry E. Wilson, Ironton, OH (US)

(73) Assignee: J.H. FLETCHER & CO., Huntington, WV (US)

( * ) Notice: Subject to any disclaimer, the term of this patent is extended or adjusted under 35 U.S.C. 154(b) by 548 days.

(21) Appl. No.: 13/722,011

(22) Filed: Dec. 20, 2012

(51) Int. Cl.

| | |
|---|---|
| ***E21B 21/015*** | (2006.01) |
| ***E21B 21/01*** | (2006.01) |
| *E21B 7/00* | (2006.01) |
| *E21B 21/00* | (2006.01) |

(52) U.S. Cl.
CPC ..... *E21B 21/015* (2013.01); *E21B 21/01* (2013.01); *E21B 7/00* (2013.01); *E21B 21/00* (2013.01)

(58) Field of Classification Search
CPC ..... E21B 21/015; B05B 17/08
USPC ..... 175/209; 173/75
See application file for complete search history.

(56) References Cited

U.S. PATENT DOCUMENTS

| | | | | |
|---|---|---|---|---|
| 551,465 | A | 12/1895 | Elliot | |
| 2,590,958 | A * | 4/1952 | Goodrich | 175/209 |
| 2,646,256 | A * | 7/1953 | Lobbert | E21B 21/015 175/209 |
| 3,165,158 | A | 1/1965 | Horten et al. | |
| 3,924,696 | A | 12/1975 | Horlin et al. | |
| 3,985,367 | A * | 10/1976 | Martino et al. | 279/20 |
| 4,416,337 | A | 11/1983 | Phillips et al. | |
| 4,921,375 | A | 5/1990 | Famulari | |
| 4,946,322 | A | 8/1990 | Colligan | |
| 5,199,501 | A | 4/1993 | Klueber et al. | |
| 5,467,835 | A | 11/1995 | Obermeier et al. | |
| 5,492,183 | A | 2/1996 | Sollami | |
| 5,690,183 | A | 11/1997 | Sollami | |
| 5,842,529 | A * | 12/1998 | Dietzen | 175/66 |
| 5,983,445 | A | 11/1999 | Baker | |
| 6,695,071 | B1 | 2/2004 | DeVall | |
| 7,520,341 | B1 | 4/2009 | DeVall | |
| 7,901,164 | B2 | 3/2011 | Skradski et al. | |
| 2005/0238479 | A1 * | 10/2005 | Zamfes | F04D 29/2277 415/71 |
| 2011/0017600 | A1 * | 1/2011 | Larson | E21B 21/065 204/557 |

* cited by examiner

*Primary Examiner* — Jennifer H Gay
*Assistant Examiner* — George Gray
(74) *Attorney, Agent, or Firm* — King & Schickli, PLLC

(57) ABSTRACT

A pump collects waste fluid and debris from the drilling of a borehole in a mine and for disposing of the waste fluid in a controlled manner. The pump collects the waste fluid into the pump housing through a grate. The pump also includes a centrally located hole which allows a drilling shaft to pass through the body of the pump. The pump further includes a funnel-shaped collar for collecting waste fluid that is dispersed from the mine borehole. A drill head may be attached to the pump for powering the drilling shaft, and for powering an impeller within the pump.

16 Claims, 7 Drawing Sheets

PUMP FOR USE WITH MINE DRILL AND RELATED METHODS

TECHNICAL FIELD

The present disclosure relates to the mining arts, and more particularly, to an apparatus for removing debris in conjunction with a roof drilling apparatus in a mine.

BACKGROUND OF THE INVENTION

Most earth drilling systems employ some form of rotary or percussion powered drills. Typically, a drilling machine, such as for forming a hole for an explosive charge, or for anchoring a roof bolt, includes a drill socket for receiving a stem with a drill bit on the distal down hole section thereof. The stem/bit on a rotary drill machine is rotated by a shaft, sometimes called a spinner, mounted on a drill head to form the drill hole. The rotary driving motion of the spinner is usually hydraulically or pneumatically driven.

Various types of drilling systems utilize a drilling fluid in combination with a drilling tool. This drilling fluid may be a liquid such as water or a water-containing liquid. The uses of a drilling fluid may include assisting in removing drill cuttings from a borehole, stabilizing borehole walls to prevent caving, controlling dust produced during the drilling process, and cooling and cleaning the drill bit. Such use of a drilling tool with a drilling fluid may be termed wet-drilling.

As can be seen in FIG. 1, wet-drilling generally involves the introduction of the drilling fluid into a borehole in a surface to be drilled, such as through a channel within the drill bit. As the drilling fluid is introduced into the borehole, the fluid cools the cutting edge of the drill bit and flush away the dust and cuttings within the borehole. The combination of fluid and cuttings is generally forced out of the borehole through an annulus between the drill bit and the borehole. By flushing away the cuttings, the longevity of the drill bit may be extended because the drill bit is not forced to continuously re-cut the cuttings within the borehole. By reducing or eliminating the dust created during the drilling process, the air quality in the mine may be greatly improved.

In the case of overhead drilling, such as in the drilling in the roof of a mine shaft, the amount of drilling fluid used may be increased in comparison to a horizontally drilled borehole. This additional fluid may be necessary to maintain the advantages of wet-drilling, as gravity forces the fluid out of the overhead borehole more quickly than a horizontal borehole. As gravity forces the combination of fluid, dust, and cuttings (i.e. the waste fluid) down the shaft of the drill bit, the spinning of the drill, especially at the drill head, may cause this waste fluid to be rapidly and somewhat violently dispersed in the mine shaft in the area of the drill. This dispersed waste fluid deleteriously accumulates in the mine and makes for unpleasant working conditions.

Accordingly, a need is identified for an apparatus that provides an improvement in wet-drilling overhead boreholes within a mine.

SUMMARY

One aspect of the disclosure is an apparatus for use in wet drilling a face of a mine passage with a fluid. The apparatus includes a drill head for drilling the face using the fluid and a pump associated with the drill head for collecting used fluid and for directing fluid away from the drill head. In one embodiment the pump is a centrifugal pump. In another embodiment, the apparatus further includes an impeller for inducing flow of the fluid in an exiting direction which is generally perpendicular to an entering direction.

The drill head and the pump may each include an opening for receiving a drilling member for drilling the face of the mine passage. The pump may be attached to the drill head such that the opening in the drill head is coaxial with the opening of the pump.

In another embodiment, the pump includes a housing forming a chamber surrounding an impeller. The housing may include an inlet and an outlet. The inlet may include a frustoconical collar for directing fluid into the pump.

Another aspect of the disclosure relates to an apparatus for use with a drilling shaft in wet-drilling a face of a mine passage with a liquid. The apparatus includes a drill head for powering the drilling shaft for drilling the face in connection with the liquid and a centrifugal pump adapted for collecting used liquid and for directing said fluid away from the drill head.

In one embodiment, the pump includes an impeller. The impeller may comprise an annular disc having a plurality of curved blades for displacing the liquid.

In another embodiment, the apparatus further includes a first motor for driving the drilling shaft. The first motor may also drive the centrifugal pump. Alternately, the apparatus may include a second motor for driving the centrifugal pump.

An additional embodiment further includes a pump housing, wherein the housing comprises an inlet concentric with the drilling shaft and an outlet. The inlet may further include a grate.

In a further embodiment, the drill head and centrifugal pump may each include an aperture for receiving the drilling shaft, and the apertures may be aligned concentrically.

A further aspect of the disclosure relates to a method of wet drilling a face of a mine passage. The method includes the steps of drilling a borehole into the face of the mine passage using a drilling liquid and collecting the used liquid from the drilling step. The method may further include the step of recirculating the used liquid for reuse as the drilling liquid. This may include the step of removing debris from the used liquid.

BRIEF DESCRIPTION OF THE DRAWING FIGURES

FIG. 1 illustrates a prior art drill for use in wet-drilling;

FIG. 2*a* is a perspective view of a drill apparatus according to one aspect of the disclosure;

FIG. 2*b* is a side elevational view of the apparatus;

DETAILED DESCRIPTION

One embodiment of the present invention relates to an apparatus 10 for collecting and disposing of fluid in association with a drilling tool used in combination with a drilling fluid, such as a wet drilling tool in a wet-drilling environment. The apparatus 10 may be used in conjunction with the drilling of a face 20 of a mine passage with the use of a drilling fluid F. The drilling fluid F may be a liquid such as water or a water-containing fluid.

Figure 1:
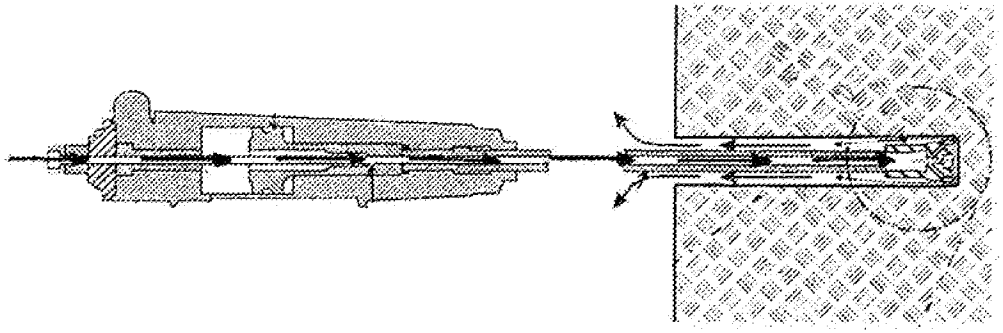
Fig. 1 (Prior Art)
Figure 2A:
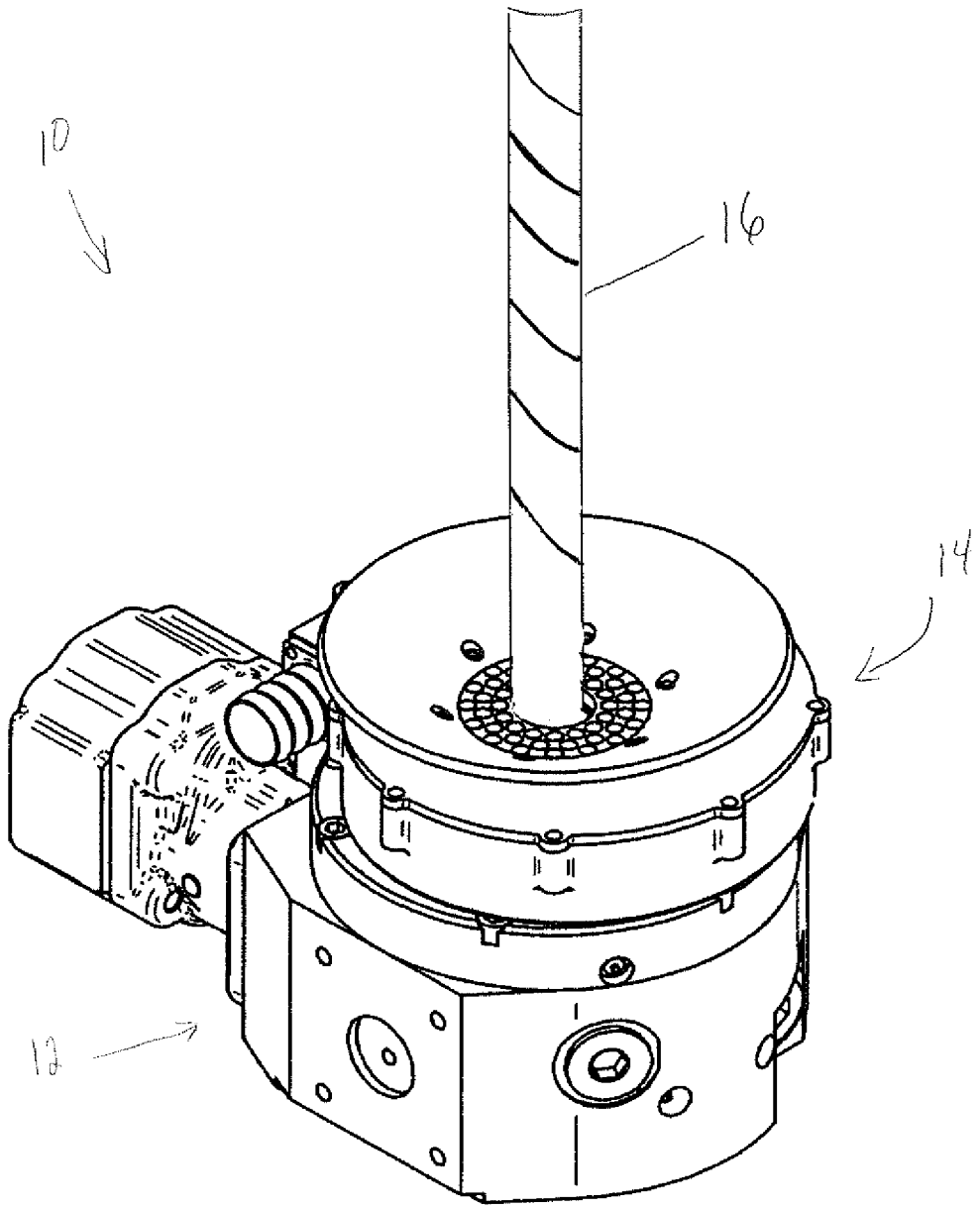
Figure 2B:
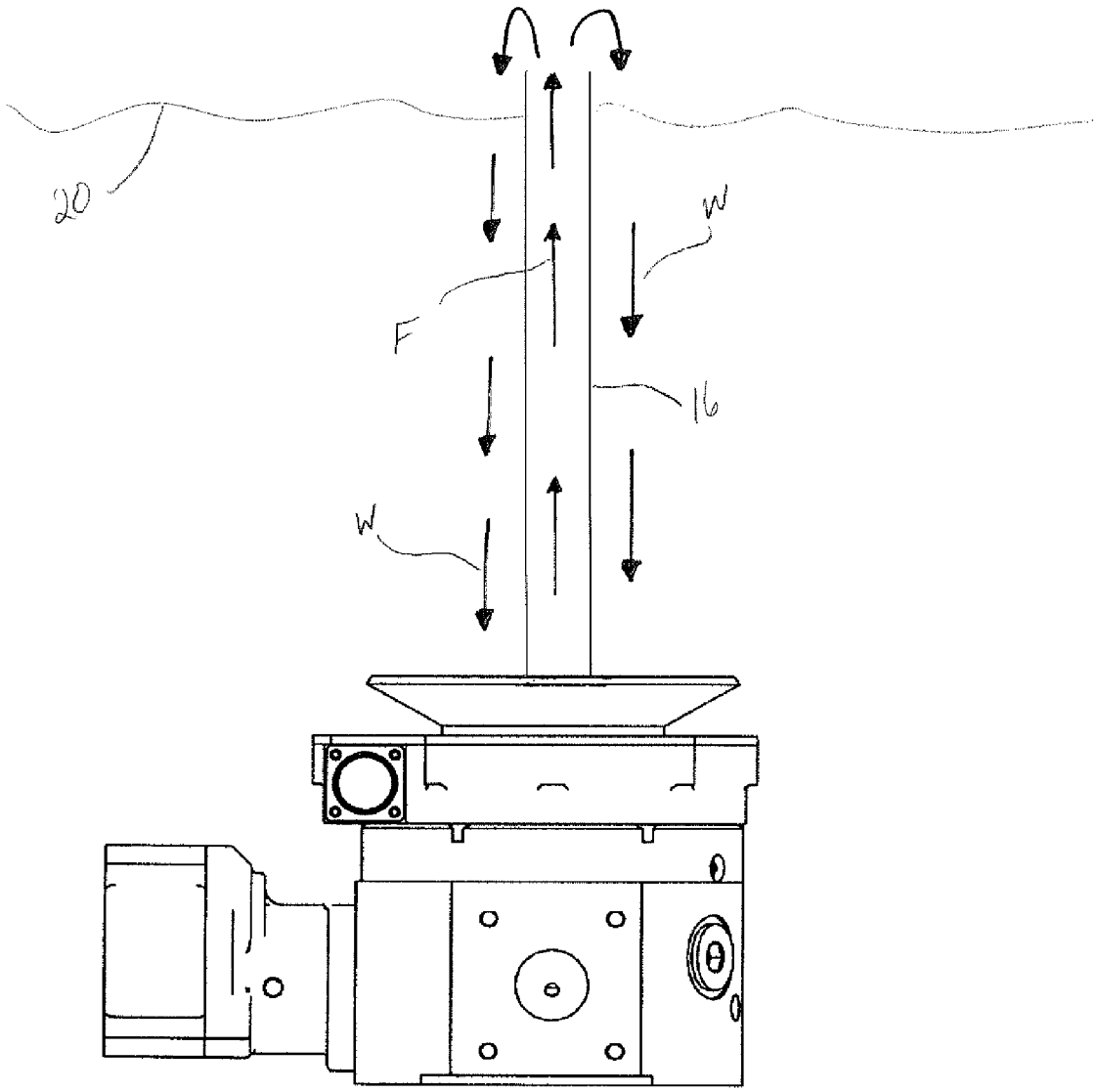

As can be seen in FIG. 2*a*, the apparatus 10 may include a drill head 12 for rotating and driving a drill shaft 16 and drill bit (not pictured). In the wet-drilling embodiment, the drilling fluid F may be introduced to the mine face 20 or borehole through a passage within the drill shaft 16 (see FIG. 2*b*). As the fluid F enters an overhead borehole and collects the dust and cuttings within the borehole, it exits the borehole as waste W. This waste W may follow a generally downward path along the drill shaft 16.

The drill head 12 may also be used in association with a pump 14 to collect this waste W. The pump 14 may be aligned with the drill head 12 along a longitudinal axis of the drill shaft 16. In that manner, the pump 14 may recover the waste W from the borehole and divert the waste to a desired location. The pump 14 may be attached to a portion of the drill head 12 such that the pump 14 lies between the borehole and the drill head 12 during use.

Figure 3:
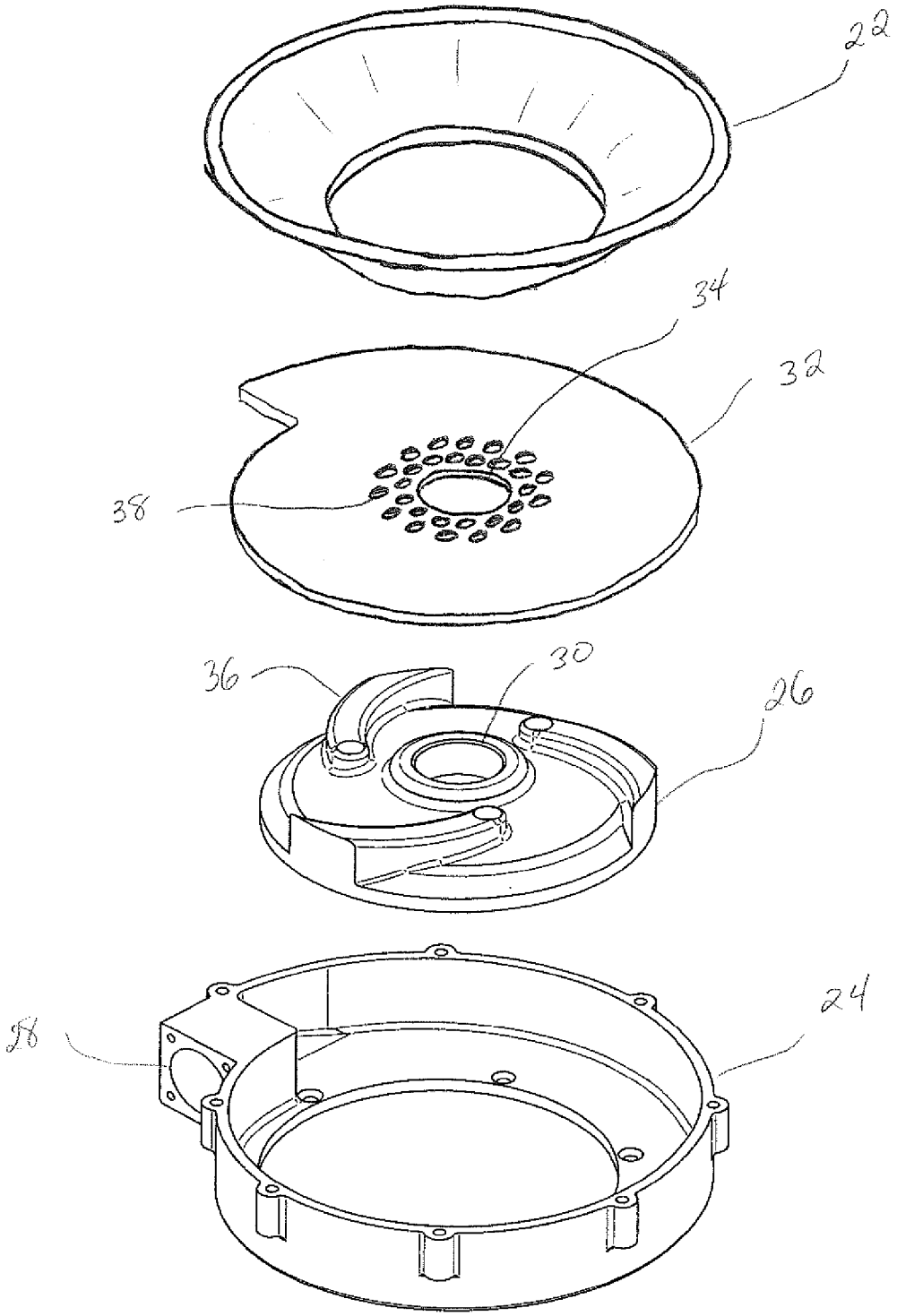
FIG. 3 is an exploded view of a pump associated with the apparatus.

The pump 14 may be any pump capable of transporting the waste W from one location to another, such as a centrifugal pump. As shown in more detail in FIG. 3, the pump 14 may include a collar 22 for collecting waste W. The collar 22 may be of a frustoconical shape, with a wide annulus facing upward, and a smaller, concentric annulus associated with the body of the pump 14. In practice, this collar 22 is adapted to collect and divert waste W to the pump.

The pump 14 may include a housing 24 for receiving the waste W collected by the collar 22. The housing 24 is sealed with a pump cover 32, which may include a central cover aperture 34 through which the drilling shaft 16 may pass. The pump cover 32 may further include one or more cover openings 38 for allowing waste W to enter the pump 14. These openings may include a mesh or filter to prevent large pieces of cuttings from entering and possibly clogging the pump. In one embodiment, the pump cover 32 includes a plurality of cover openings 38 forming a grate 39, wherein the cover openings 38 are dimensioned so as to prevent large particles from entering the pump. These cover openings 38 are located within the smaller annulus of the collar 22.

Within the housing 24, the pump 14 may further include an impeller 26 for directing the waste W to an outlet 28. The impeller 26 may take any shape capable of diverting the waste to the outlet, but is shown in the shape of an annular disc with one or more curved blades 36. The impeller 26 of a centrifugal pump is configured to direct fluid entering the top of the pump in a perpendicular direction, toward an outer wall of the housing 24.

The impeller further includes a central aperture 30 through which the drill shaft 16 may pass. The central cover aperture 34 may align with the central aperture 30 of the impeller 26. The drill shaft 16 may pass through the concentrically aligned central aperture 30 of the impeller 26 and cover aperture 34, as well as the collar 22. In this way, the drill head 12 may drive the drill shaft 16 through the pump 14. The pump 14, therefore, is positioned between the drill head 12 and the borehole during use.

Figure 4:
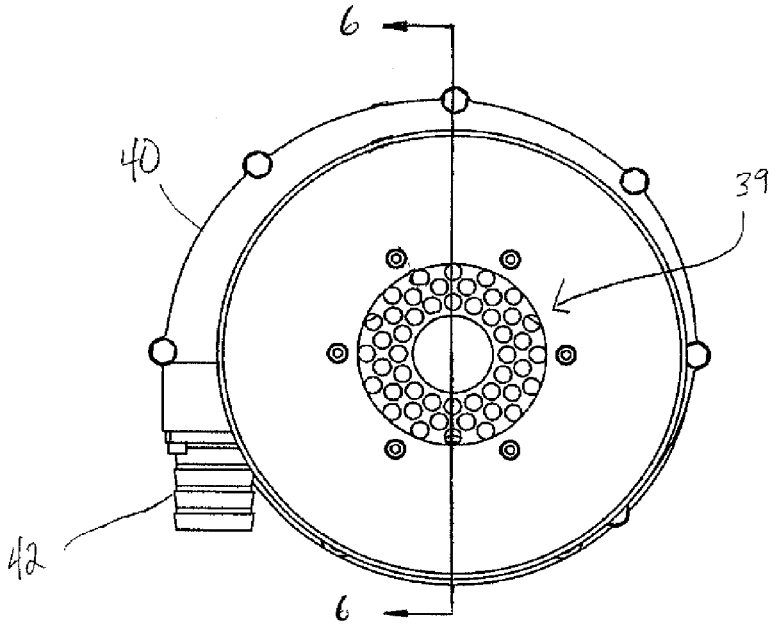
FIG. 4 is a top plan view of the pump of the above embodiment.

As can be seen in FIG. 4, the pump 14 is generally circular in shape, and the housing 24 may include an outwardly spiraling extended portion 40 for directing waste W to the outlet 28. The outlet 28 may further include a port fitting 42 for connecting the outlet 28 to a tube or hose (not shown) for transporting the waste W from the pump 14 to a desired location.

Figure 5:
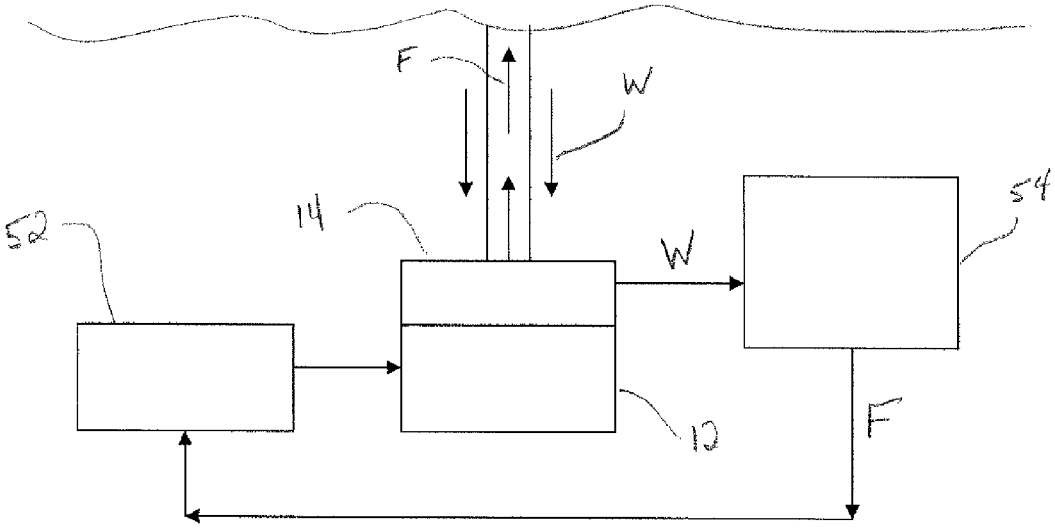
FIG. 5 is a schematic of an embodiment of the drill apparatus in use with a recirculating system.

In one embodiment, the waste W may be recirculated subsequent to collection so as to be reused as a drilling fluid F. As illustrated in FIG. 5, drilling fluid F may be supplied to the drill head 12 from a fluid source 52. The fluid F is then utilized in a wet-drilling process as described above. The waste W may be collected by the pump 14, and then may be diverted to a collector 54, wherein debris from the waste W may be removed. This collector 54 may comprise any mechanism capable of removing debris and/or sediment from the waste W, such as a filter, a settling tank, a centrifuge, or the like. Once the debris and/or sediment has been removed from the waste W, the cleaned fluid portion of the waste may be reused as drilling fluid F. This fluid F may be delivered from the collector 54 to the fluid source 52 in order to be reused within the drilling process. The transfer of fluid within this embodiment may be accomplished via gravity, or any number of pumps (not shown) associated with the various system components.

Figure 6:
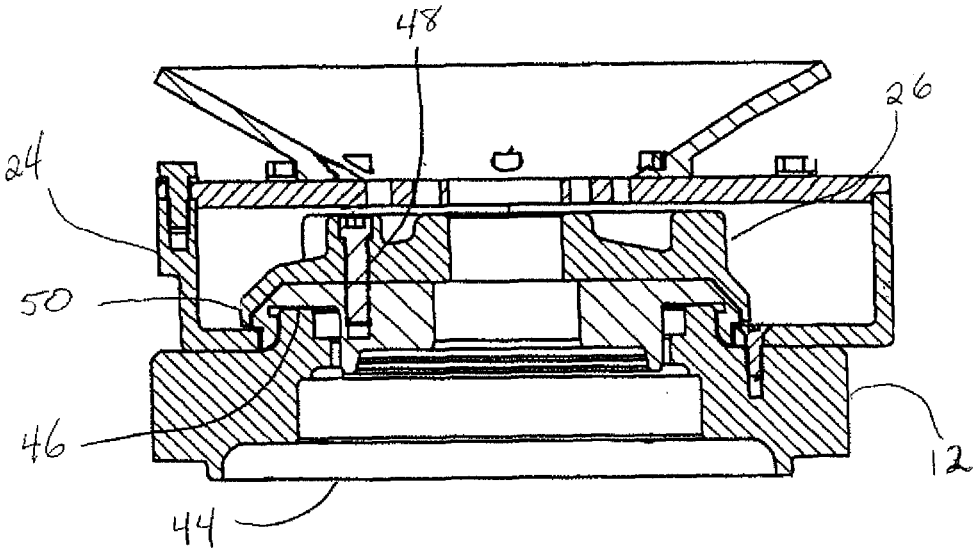
FIG. 6 is a cross-sectional view of the pump of FIG. 4 through the line 6-6.

FIG. 6 illustrates a cross-sectional view of the pump 14 and drill head 12 as viewed through line 6-6 of FIG. 4. The drill head 12 includes a driver 44 for rotating and driving the drill shaft 16. In one embodiment, the drill head 12 further includes a driving extension 46 in communication with the driver 44 for driving the impeller 26. The driving extension 46 may engage an underside of the impeller within the housing 24 through one or more connectors 48. These connectors 48 may be in the form of a screw, bolt, or any other fitment for holding the impeller 26 and driving extension 46 in relative contact for coordinated movement.

Figure 7:
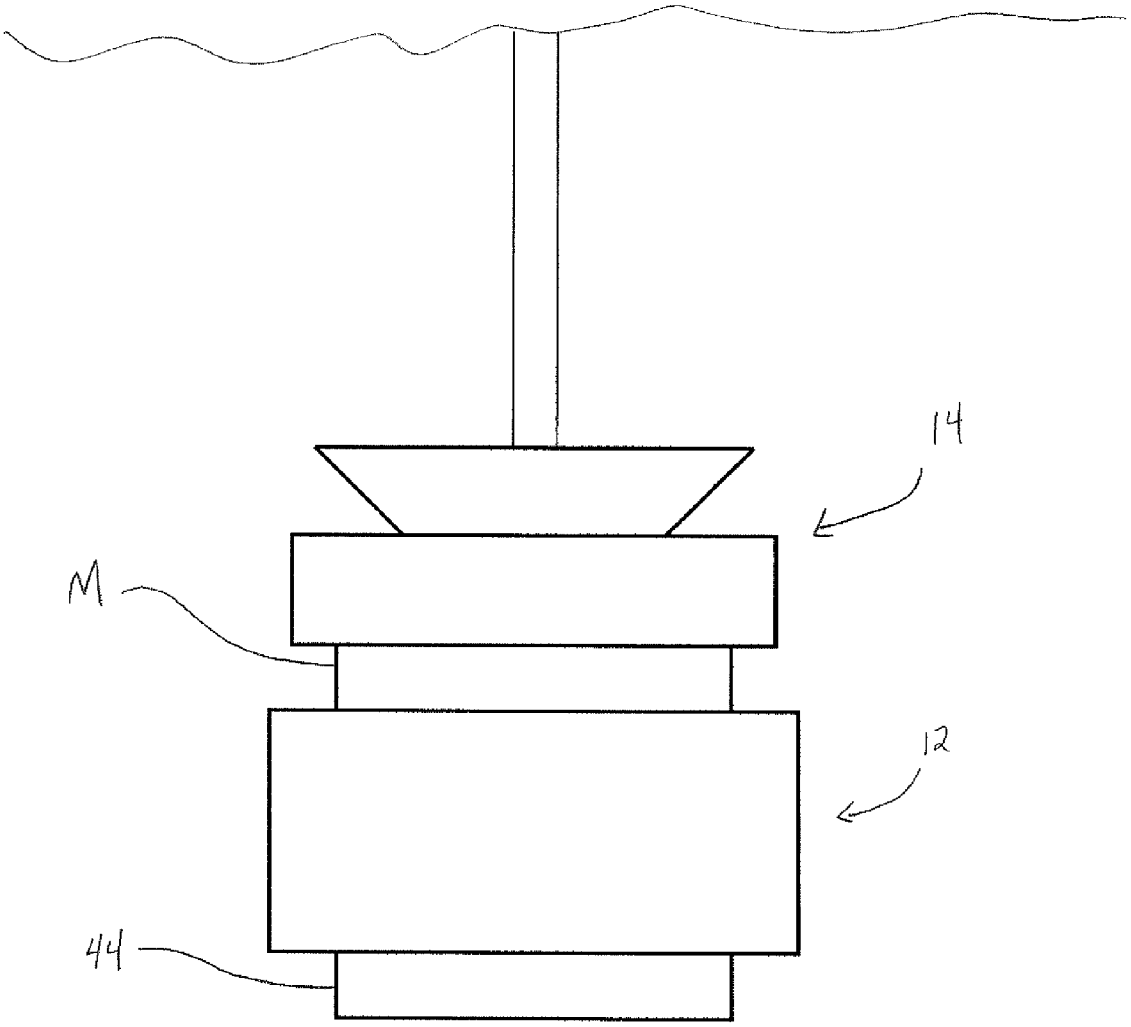
FIG. 7 is a front elevational view of one embodiment of the apparatus.

The driver 44 of the drill head 12 may be configured for simultaneously driving both the drill shaft and the impeller 26. In such an embodiment, the impeller 26 may further include an extension 50 dimensioned for contacting the housing 24 so as to seal an internal volume of the housing 24 from the driver 44 and the drive extension 46. In an alternate embodiment as shown in FIG. 7, the pump 14 may include a motor M for driving the impeller 26 independently of the drill head 12.

The foregoing descriptions of various embodiments are provided for purposes of illustration and not intended to be exhaustive or limiting. Modifications or variations are also possible in light of the above teachings. The embodiments described above were chosen to provide the best application to thereby enable one of ordinary skill in the art to utilize the disclosed embodiments and with various modifications as are suited to the particular use contemplated. All such modifications and variations are within the scope of the claimed inventions.

The invention claimed is:

1. An apparatus for use in wet drilling a face of a mine passage with a fluid, said apparatus comprising:

a drill head for drilling the face using the fluid; and a centrifugal pump associated with the drill head for receiving used fluid and for directing used fluid away from the drill head;

wherein the drill head and the centrifugal pump each include an opening for receiving a drilling member for drilling the face of the mine passage.

2. The apparatus of claim 1, further including an impeller for inducing flow of the fluid in an exiting direction which is generally perpendicular to an entering direction.

3. The apparatus of claim 1, wherein the pump is attached to the drill head such that the opening in the drill head is coaxial with the opening of the pump.

4. The apparatus of claim 1, wherein the pump includes a housing forming a chamber surrounding an impeller.

5. The apparatus of claim 4, wherein the housing further includes an inlet and an outlet.

6. The apparatus of claim 5, wherein the inlet includes a frustoconical collar for directing fluid into the pump.

7. An apparatus for use with a drilling shaft in wet-drilling a face of a mine passage with a liquid, said apparatus comprising:

a drill head for powering the drilling shaft for drilling the face in connection with the liquid; and a centrifugal pump adapted for receiving used liquid and for directing said liquid away from the drill head;

wherein the drill head is associated with a first motor for driving the drilling shaft and the centrifugal pump.

8. The apparatus of claim 7, wherein the pump includes an impeller.

9. The apparatus of claim 8, wherein the impeller comprises an annular disc having a plurality of curved blades for displacing the liquid.

10. The apparatus of claim 7, further including a pump housing, said housing comprising an inlet concentric with the drilling shaft and an outlet.

11. The apparatus of claim 10, wherein the inlet further includes a grate.

12. The apparatus of claim 7, wherein the drill head and centrifugal pump each include an aperture for receiving the drilling shaft, and wherein the apertures are concentrically aligned.

13. An apparatus for use in wet drilling a face of a mine passage with a fluid, said apparatus comprising:

a drill head for drilling the face using the fluid; and a centrifugal pump associated with the drill head for receiving used fluid and for directing used fluid away from the drill head, wherein the pump includes a housing forming a chamber surrounding an impeller;

wherein the housing further includes an inlet and an outlet;

wherein the inlet includes a frustoconical collar for directing fluid into the pump.

14. An apparatus for use with a drilling shaft in wet-drilling a face of a mine passage with a liquid, said apparatus comprising:

a drill head for powering the drilling shaft for drilling the face in connection with the liquid;

a centrifugal pump adapted for receiving used liquid and for directing said liquid away from the drill head; and a pump housing, said pump housing comprising an inlet concentric with the drilling shaft and an outlet.

15. The apparatus of claim 14 wherein the inlet further includes a grate.

16. An apparatus for use with a drilling shaft in wet-drilling a face of a mine passage with a liquid, said apparatus comprising:

a drill head for powering the drilling shaft for drilling the face in connection with the liquid; and a centrifugal pump adapted for receiving used liquid and for directing said liquid away from the drill head;

wherein the drill head and centrifugal pump each include an aperture for receiving the drilling shaft, and wherein the apertures are concentrically aligned.

* * * * *